United States Patent [19]

Brown

[11] Patent Number: 4,559,779

[45] Date of Patent: Dec. 24, 1985

[54] DISPLACER FOR STIRLING ENGINE

[75] Inventor: Alec T. Brown, Ballston Lake, N.Y.

[73] Assignee: Mechanical Technology Incorporated, Latham, N.Y.

[21] Appl. No.: 756,958

[22] Filed: Jul. 18, 1985

[51] Int. Cl.[4] ..... F02G 1/04

[52] U.S. Cl. ..... 60/517

[58] Field of Search ..... 60/517, 518

[56] References Cited

U.S. PATENT DOCUMENTS 1,073,065 9/1913 Anderson et al. ..... 60/518

*Primary Examiner*—Allen M. Ostrager

*Attorney, Agent, or Firm*—Joseph C. Sullivan; Joseph V. Claeys

[57] ABSTRACT

In a Stirling engine and the like, a displacer piston having a plurality of internal baffles and insulation so as to prevent undesired heat transfer across the displacer piston.

10 Claims, 1 Drawing Figure

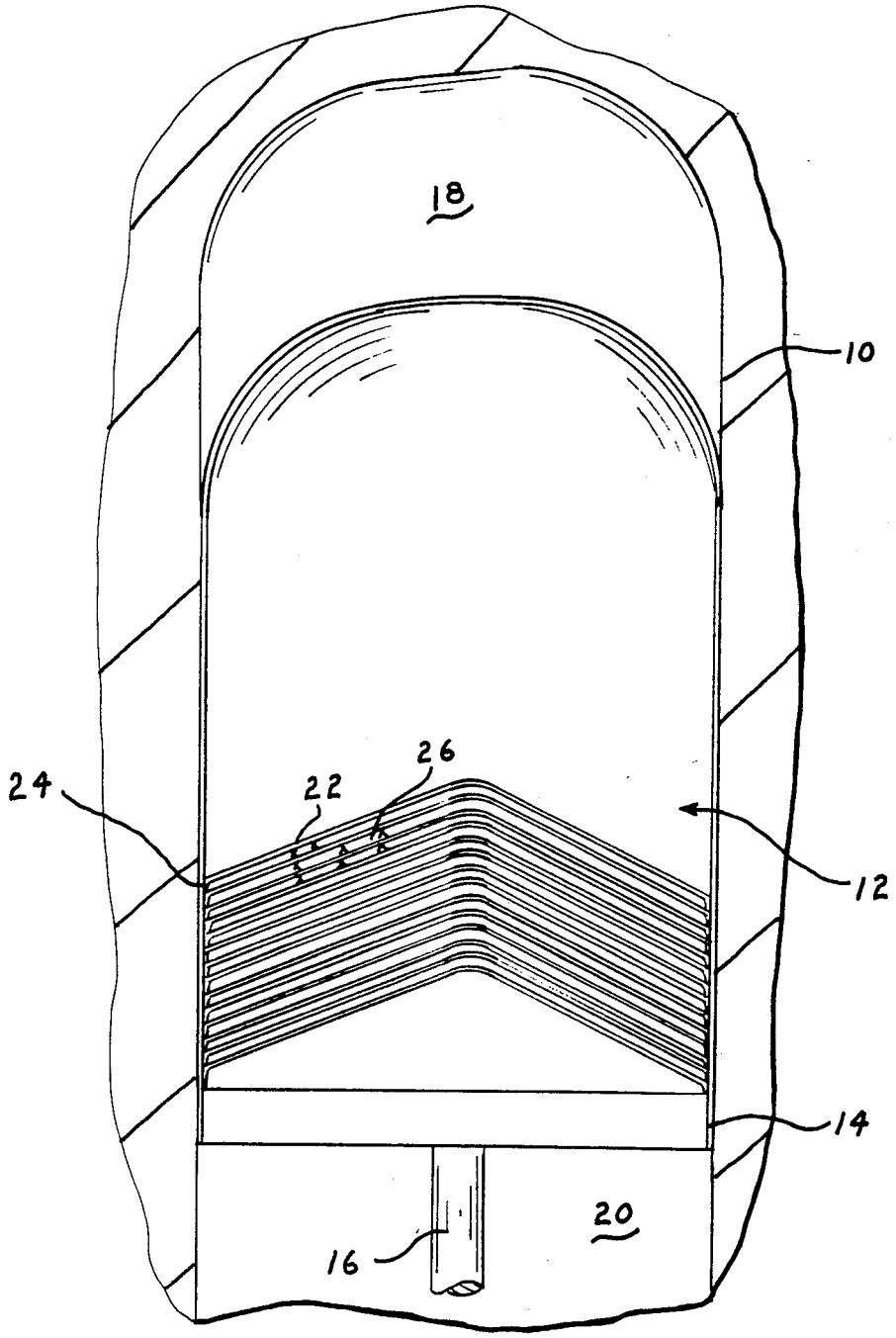
18
10
26
22
24
12
14
20
16

DISPLACER FOR STIRLING ENGINE

FIELD OF THE INVENTION

The present invention is directed toward an improved displacer for use in a Stirling engine and the like.

BACKGROUND OF THE INVENTION

With the renewed and ever expanding interest in Stirling engines, efforts have been made to continually improve upon their design. Basic Stirling engine principals of operations are set forth in a text entitled "Stirling Engines" by G. Walker, 1st Edition, 1980. Essentially, in this regard, a Stirling engine operates on the principal of heating and cooling a working fluid (gas), with the expansion and compression of the gas utilized to perform useful work. A variety of designs are illustrated in the aforenoted text with their attendant advantages.

In the Stirling cycle, a working gas is shuttled between two stationary volume chambers or spaces, the expansion space and the compression space. This shuttling is typically performed by a displacer. During operation of the engine, a very small pressure differential exists across the displacer however a large thermal differential exists across the displacer since the temperature of the working gas is different between the expansion (hot) space and the compression (cold) space. To improve the efficiency of the operation of the engine, there is a need to reduce losses resulting from shuttle heat transfer through the displacer which result when the regenerator cooler is bypassed. Since such heat loss is not available to the working fluid, it reduces the engine operating efficiency. However, previous attempts to provide effective thermal resistance in the displacer capable of withstanding the inertia loads associated with displacer motion and practical weight restrictions have not been entirely satisfactory.

Accordingly, there exists a need to compensate for such thermal losses while not unduly complicating nor adding to the weight and the cost of the engine.

SUMMARY OF THE INVENTION

It is a principal object of the invention to increase the efficiency of a Stirling engine by compensating for the thermal transfer across the displacer. It is a further object to reduce such thermal transfer in a relatively simple and economic manner.

The aforenoted objects are achieved by the present invention which provides for a plurality of thin closely spaced baffles disposed within the displacer piston of a Stirling engine which reduces the amount of heat flowing from the hot space to the cold space via the displacer. The baffles may be fabricated from any suitable material such as sheet-metal and, if desired, may incorporate a low density ceramic insulation between them. Such an arrangement results in a significant and desirable reduction in heat transfer and improved efficiency while being relatively light and cost effective.

BRIEF DESCRIPTION OF THE DRAWING

Thus, by the aforenoted invention, its objects and advantages will be realized, the description of which should be taken in conjunction with the drawing wherein:

FIG. 1 is partial sectional view of a Stirling engine cylinder including a displacer incorporating the teachings of the present invention.

DETAILED DESCRIPTION OF THE PREFERRED EMBODIMENT

Turning now more particularly to the figure, there is shown a cylinder wall 10 for a Stirling engine or the like having contained therein a displacer 12. As is typical in Stirling engines, the displacer piston 12 includes a relatively light weight hollow body 14 mounted on a rod 16 and serves to shuttle the working gas between the expansion space (hot) 18 and the compression space (cold) 20. In normal operation, due to the high temperature gradient between the expansion and compression spaces, axial heat flow through the displacer piston 12 can be expected. In accordance with this invention, this heat flow is reduced by providing the displacer 12 with a series of circular conically shaped spaced baffles 22 positioned in layered fashion throughout its interior as shown. Each of the baffles 22 is provided with a peripheral flange 24 which allows for spaced stacking thereof. As shown in the figure, the flange of each baffle abuts the next to provide capability to withstand the inertial loads associated with displacer motion. In one particular arrangement, a reduction of heat flow bypassing the regenerator, of more than 200 watts to less than 50 watts was realized, resulting in increased engine efficiency of 2–3%. The weight of the displacer 12 was only increased by approximately 5%, i.e., .2 lbs. in 4 lbs.

In addition the arrangement, if desired, may include an insulating material such as low density ceramic disposed between the respective baffles 22 to decrease the potential for both convection and radiation heat transfer.

Thus by the present invention, its objects and advantages are realized, and although a preferred embodiment has been disclosed and described in detail herein, its scope should be determined by that of the appended claims.

What is claimed is:

1. In an external combustion engine such as a Stirling engine and the like in which a cycle of operation includes moving a working gas between expansion and compression spaces, a displacer for moving the working gas, said displacer having a hollow interior area; a plurality of circular, conically shaped spaced baffles axially positioned in a layered fashion in said hollow interior; and said baffles being positioned in the interior area so as to prevent undesired heat transfer across the displacer.

2. The invention in accordance with claim 1 wherein said spacing means includes projecting means abutting a respective adjacent baffle.

3. The invention in accordance with claim 2 in which said projecting means includes a peripheral flange.

4. The invention in accordance with claim 3 wherein insulating material is provided between adjacent baffles.

5. The invention in accordance with claim 4 wherein said insulating material is low density ceramic material.

6. The invention in accordance with claim 1 which includes insulating material between adjacent baffles.

7. The invention in accordance with claim 6 wherein said insulating material is low density ceramic material.

8. The invention in accordance with claim 1 wherein said baffles are positioned throughout the interior of said displacer dome.

9. The invention in accordance with claim 2 wherein said baffles are positioned throughout the interior of said displacer dome.

10. The invention in accordance with claim 3 wherein said baffles are positioned throughout the interior of said displacer dome.

* * * * *